United States Patent [19]

Gühring

[11] Patent Number: 4,642,942

[45] Date of Patent: Feb. 17, 1987

[54] METHOD AND APPARATUS FOR GRINDING THE TIP OF A TWIST DRILL

[75] Inventor: Knut Gühring, Ebingen, Fed. Rep. of Germany

[73] Assignee: Gottlieb Guhring, Ebingen, Fed. Rep. of Germany

[21] Appl. No.: 755,003

[22] Filed: Jul. 16, 1985

Related U.S. Application Data

[63] Continuation of Ser. No. 460,922, Jan. 25, 1983, abandoned.

[30] Foreign Application Priority Data

Jan. 26, 1982 [DE] Fed. Rep. of Germany ..... 3202362

[51] Int. Cl.[4] ..... B24B 3/28; B24B 3/32

[52] U.S. Cl. ..... 51/100 R; 51/219 PC; 51/288

[58] Field of Search ..... 51/34 A, 35, 93, 94 R, 51/94 CS, 100 R, 219 R, 219 PC, 288

[56] References Cited

U.S. PATENT DOCUMENTS

| | | | |
|---|---|---|---|
| 2,477,135 | 7/1949 | Marker et al. | 51/100 R |
| 2,632,983 | 3/1953 | Kapnick | 51/219 PC |
| 2,797,538 | 7/1957 | Studler | 51/219 PC |
| 3,209,493 | 10/1965 | Houser | 51/219 R X |
| 3,621,613 | 11/1971 | Grob et al. | 51/288 X |
| 3,751,856 | 8/1973 | Jorgensen | 51/100 R |
| 3,788,009 | 1/1974 | Williams et al. | 51/100 R X |

FOREIGN PATENT DOCUMENTS

| | | | |
|---|---|---|---|
| 1072501 | 12/1959 | Fed. Rep. of Germany . | |
| 2656491 | 6/1978 | Fed. Rep. of Germany | 51/219 PC |
| 1952217 | 9/1979 | Fed. Rep. of Germany . | |
| 474329 | 8/1969 | Switzerland | 51/219 PC |

*Primary Examiner*—Robert P. Olszewski

*Attorney, Agent, or Firm*—Anthony H. Handal

[57] ABSTRACT

Described herein is an apparatus for grinding a twist drill bit, especially for web thinning and split pointing of the tip of a twist drill. The apparatus includes a grinding disk and a drill bit holder movable relative thereto mounted on a support. The support may execute relative motion with respect to the grinding disk under cam control in two coordinates and using a grinding disk having an invariable profile, in order to produce tip grinding patterns of various types. Preferably, the cam control is performed by means of interchangeable templates so that it is possible, using only a single grinding disk, no longer subject to the necessity of dressing, to produce a multiplicity of tip surface patterns that are optimally adapted to the given drill bit geometry.

27 Claims, 7 Drawing Figures

METHOD AND APPARATUS FOR GRINDING THE TIP OF A TWIST DRILL

This application is a continuation of application Ser. No. 460,922, filed Jan. 25, 1983, now abandoned.

BACKGROUND OF THE INVENTION

The invention relates of an apparatus for grinding especially for web thinning and split pointing of the tip of a twist drill.

Web thinning and split pointing of a sharpened tip of a twist drill bit is known in order to reduce the size of the transverse cutting edge to diminish axial forces, i.e., the forces necessary to advance the drill bit. In addition, web thinning and split pointing improves the cutting conditions at the transition from the transverse cutting edge to the main cutting edge. Therefore, web thinning and split pointing, i.e. the grinding of the core of the tip of the drill, has a substantial effect upon the cutting characteristics of a twist drill bit. It is possible to perform the web thinning operation by hand, although great dexterity is required to prevent errors. For that reason, twist drill web thinning and split pointing machines and devices have been designed to make possible the production of reproducible and precisely defined tip patterns on the drill bit.

The known helical drill tip web thinning and split pointing machines include a profiled grinding disk and a drill holding device that permits positioning the twist drill to be sharpened in a pre-determined spatial angular relationship relative to the grinding disk. To perform the grinding operation, the drill bit is oriented relative the grinding disk in such a way that the grinding disk profile, when viewed in the direction which is coincident with the intended direction of relative motion between the grinding disk and the drill holder, will produce the desired tip surface on the twist drill bit. The tip pattern will then be ground into the tip of the drill bit by reciprocal motion of the grinding disk or of the drill holder.

Due to the severe effect upon the cutting properties of the drill, the tip surface must be optimally adapted to the prevailing cutting edge geometry and the profile of the grinding disk which grinds the tip surface must be adapted to the prevailing cutting geometry. Accordingly, it is necessary, for example, to provide different profiled grinding disks for drills of different diameter, which makes the known tip grinding, i.e. web thinning and split pointing method expensive due to the relatively high expense for tools. Moreover, the required exchange of the profiled grinding disks causes tool exchange delays which add further costs to the known tip grinding method. In addition, the above-mentioned necessary high quality of the tip surface necessitates repeated dressing of the profiled grinding disks, thereby sharply increasing the amount of labor of the known tip grinding method and further increasing the cost of the overall method. Still further, the known tip grinding method involves high expense for machinery because expensive dressing machines are necessary to dress the profile disks to insure uniform grinding quality.

SUMMARY OF THE INVENTION

It is an object of the invention to provide an apparatus for grinding web thinning split pointing the tip of a twist drill, making possible a more economical tip grinding i.e. web thinning method.

According to the invention, the profiled grinding disk having a profiled contour that corresponds to the tip surface is replaced by a grinding disk with a profile that is constant in shape and is independent of the tip surface to be produced. In order to make possible the production of different tip surfaces with the use of an invariable disk profile, the previously one-dimensional relative motion between the grinding disk and the drill holder is augmented by one dimension, thereby enabling a spatial relative motion between the grinding disk and the drill or drill holder. According to the invention, this spatial motion is cam-controlled so that a single grinding disk can be used to produce a plurality of tip surfaces. As the tip surface formed by web thinning is usually very small, it is perfectly sufficient to provide for two-coordinate cam controlled or continuous path controlled relative motion between the grinding disk and the drill holder in order to obtain a high-quality tip grinding pattern, so that the cutting area of the grinding disk according to the invention passes, during its operation, over an area equal to the previously required surface of the profiled grinding disk. The slight curvature of the tip surface resulting from the grinding method of the invention at the side remote from the point of the drill has no influence on the cutting characteristics of the twist drill as this curved surface does not extend into the main or auxiliary cutting edges of any location. Thus, the addition of only one degree of freedom of motion as betwwen the grinding disk and the drill holder makes it possible to dispense with the previously required effort of dressing the various profiled grinding disks and of exchanging the disks making possible a substantially more economical tip grinding, i.e. web thinning and split pointing operation of twist drills than was heretofore possible. The somewhat greater initial purchase costs of the grinding disk having an invariable disk profile as compared with one having a dressable profile are amply compensated by the sharply reduced cost of operation so that great economical advantages result even when using extremely wear-resistant and thus expensive grinding disks having diamond or (cubic) boron nitride coatings.

The use of a cam controlled motion can be an auxiliary device for an existing grinding machine.

The required degrees of freedom of motion between the drill tip and the grinding disk for obtaining different tip surfaces formed by web thinning can be assured by linear or rotational movements. It is also possible to combine one linear degree of freedom with a rotational one. A particularly simple construction results from providing two rotational degrees of freedom although care must be taken that the path traversed by the tip of the drill or the grinding disk during the operation is not excessively curved.

In accordance with an embodiment of the invention it is possible to introduce the drive power in only one direction and still induce a relative motion between the grinding disk and the drill holder or drill tip in two coordinates. This embodiment makes advantageous use of the potential energy of the support to guide it exactly along a track.

In accordance with an embodiment of the invention the desired degrees of freedom can be provided in the smallest possible space and with the least amount of apparatus.

In accordance with an embodiment of the invention th motion of the apparatus can be finely adjusted.

BRIEF DESCRIPTION OF THE DRAWING

The invention will now be described in detail with the aid of schematic drawings and an exemplary embodiment wherein.

DESCRIPTION OF THE PREFERED EMBODIMENT(S)

Figure 1:
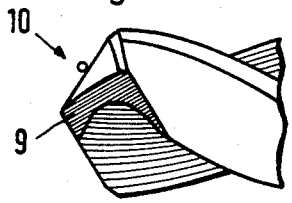
FIGS. 1 and 1*a* and FIGS. 2 and 2*a* are respective showings of different twist drill tip grinding patterns with respective modified tip surfaces, obtained by web thinning and split pointing.
Figure 1A:
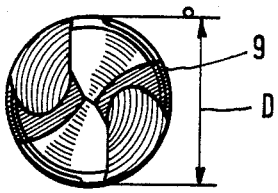
Figure 2:
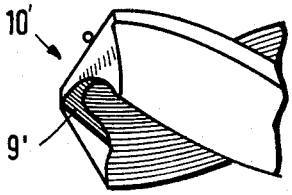
Figure 2A:
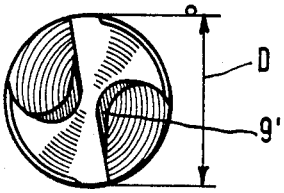

Each of the FIGS. 1, 1*a*, 2 and 2*a* shows two views of respective tip grinding patterns for double twist drills 10 and 10' with web thinning and split pointing been performed in the region of the core tip. The tip grinding surfaces that have been produced during web thinning operation are labeled 9 9' in FIGS. 1 and 2. The representations of FIGS. 1 and 2 show that the tip surfaces have a different form, depending on the requirements made of the particular drill. For example, in one case, the tip surface 9 can be used to correct the main cutting edge whereas, in another case, it is merely intended to shorten the transverse edge and to improve the cutting conditions at the transistion between the main and transverse cutting edges.

In order to obtain reproducible grinding patterns on a double twist drill, for example, the tip grinding should be done by machine. In the past, each tip surface required a separate profiled grinding disk which produced a tip surface that was adapted to the particular drill geometry. It is evident from FIGS. 1 and 1*a* and FIGS. 2 and 2*a* that, for example, an increase of the drill diameter D also requries a change in the profile of the profiled grinding disk to permit the production of similar cutting effects using drills of different diameter. For this reason, different profiled grinding disks have been necessary to grind drill bits of different diameter. The same is true in case the grinding pattern is adapted to different materials to be cut where the tip pattern must also receive a different shape, which was possible heretofore only by using a different profiled grinding disk.

Figure 3:
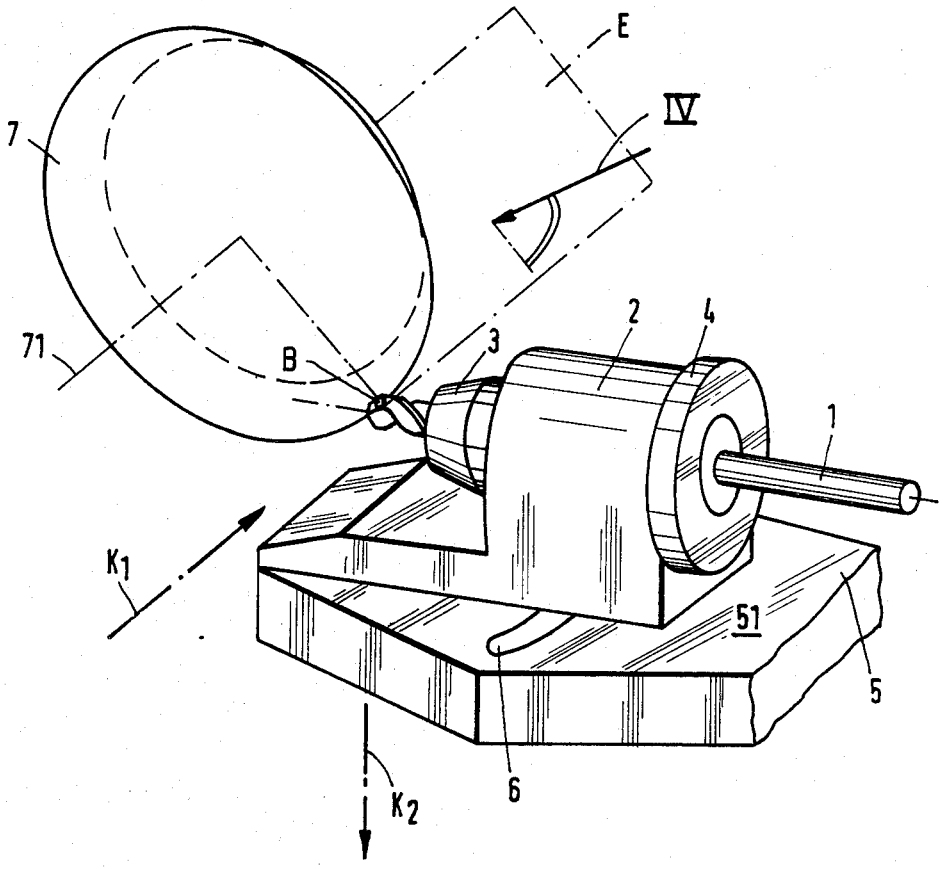
FIG. 3 is a schematic perspective view of a drill holder with a mounted twist drill into which a tip surface is being ground by a grinding disk having an invariable disk profile.

FIG. 3 illustrates schematically the kinematic conditions that are needed for an understanding of the operation of the web thinning and split pointing apparatus according to the invention. A drill bit 1 is held in a drill holder 2 or a chuck 3. In order to facilitate the positioning of the drill bit, the chuck 3 is held rotatbly within the drill holder 2. The stop ring 4 of the chuck 3 may carry a suitable angular scale to permit exact angular positioning of the chuck 3 relative to the drill holder 2. The drill holder 2 is mounted on a support 5 that permits a pivotal adjustment in the plane 51 of the support 5. To this end, there is provided within the support 5 a guidance mechanism consisting of an arcuate groove 6 cooperating with, for example, the shaft of a bolt mounted on the underside of the drill holder, which glides within the groove and the threaded portion of which is engaged by a lock nut on the bottom of the support 5. The tip of the drill bit is shown in FIG. 3 to be in contact with a grinding disk 7 shown as frustoconical in the figure. The actual contact between the grinding disk 7 and the tip of the drill bit is an area contact but it is shown as a point contact B for the sake of simplicity of the representation. Of course, the grinding disk or wheel may have a profile that is different from the frustoconical shape shown in FIG. 3 but it is of importance that the profile be invariable in shape, i.e., that its shape does not change and remains the same for all the tip surfaces of different drill bit geometries. The absence of a distinct grinding disk profile for each of the drill bits to be sharpened or ground is compensated by the possibility for relative motion between the drill bit holder 2 and the grinding disk 7 in two coordinates, K1 and K2. These coordinates may be straight or curved. For simplicity of representation, the coordinates shown in FIG. 3 have been chosen to be straight. By suitable control of the relative motion between the grinding disk 7 and the drill bit holder 2 or the drill bit 1, either the support 5 or the grinding disk is moved along the coordinates K1 and K2. If the apparatus already has a facility for moving the grinding disk in one of the two coordinates, it may be suitable to move the grinding disk 7 and the support 5 in only one coordinate direction.

The way the support 5 is moved along the coordinates K1 and K2 in a given case of a tip grinding surface obviously depends on the contour of the grinding disk profile. A simple control mechanism for obtaining a desired motion of the support may be a template which is followed by a sensing head attached fixedly to the support 5. To prevent the necessity for adjustments for even repeated grinding operations, or the necessity for dresssing the grinding disk 7 after even multiple use, it is advantageous to use a grinding disk 7 provided with an extremely hard abrasive coating. This coating may consist, for example, of diamond, but consists, preferably, of boron nitride, especially cubic boron nitride (BN). Using these coatings, the shape of the grinding wheel profile can be made absolutely invariable.

The grinding process for web thinning and split pointing the drill bit is best visualized if the drill bit tip and the contour of the grinding disk profile are viewed in a plane E containing the axis 71 of the grinding disk 7 and the point B which represents the center of the instantaneously ground tip surface region. This results in a representation, shown in FIG. 4, where the apparatus shown in FIG. 3 is viewed along the direction of the arrow IV to which the plane E is perpendicular.

Figure 4:
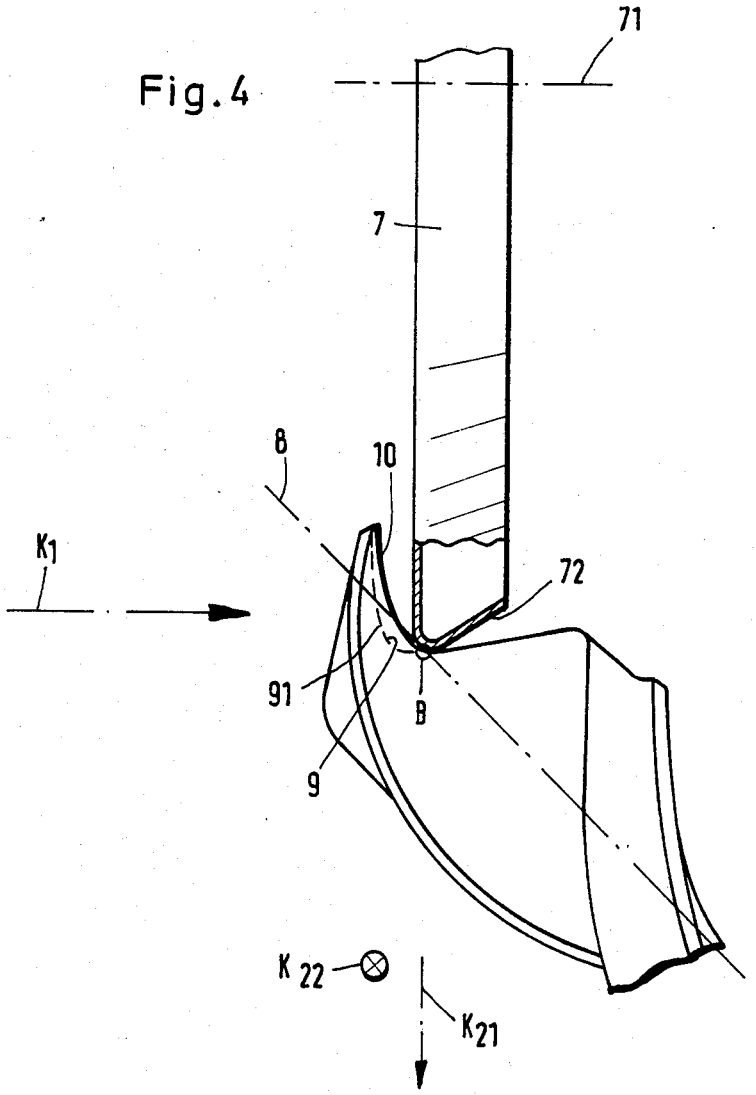
FIG. 4 is an enlarged view of the drill tip viewed in the direction of the arrow IV in FIG. 3.

When so viewed, the motion coordinate K1 is not foreshortened but the coordinate K2 is foreshortened into the coordinate K21. The illustration of FIG. 4 gives a good showing of the orientation of the drill bit axis 8 relative to the grinding disk axis 71, necessary to achieve the desired ground tip surface 9. In the configuration shown in FIG. 4, the grinding disk 7, or its abrasive coating 72, has already ground a certain portion of the area into the tip of the drill bit. In order to produce the tip surface 9 having the desired shape, the point B and hence the cutting point, which, in actuality, is a relatively short circular arc, must move along the dashed line 91. It will be seen that the two coordinates K1 and K21 are suitable for producing this curve, thus creating the desired tip surface 9. Strictly speaking, the illustration of FIG. 4, is accurate only for an infinitely large radius of curvature of the grinding disk 7. However, this radius is so large compared with the tip surface to be ground that this simplified illustrations seems justifiable.

Figure 5:
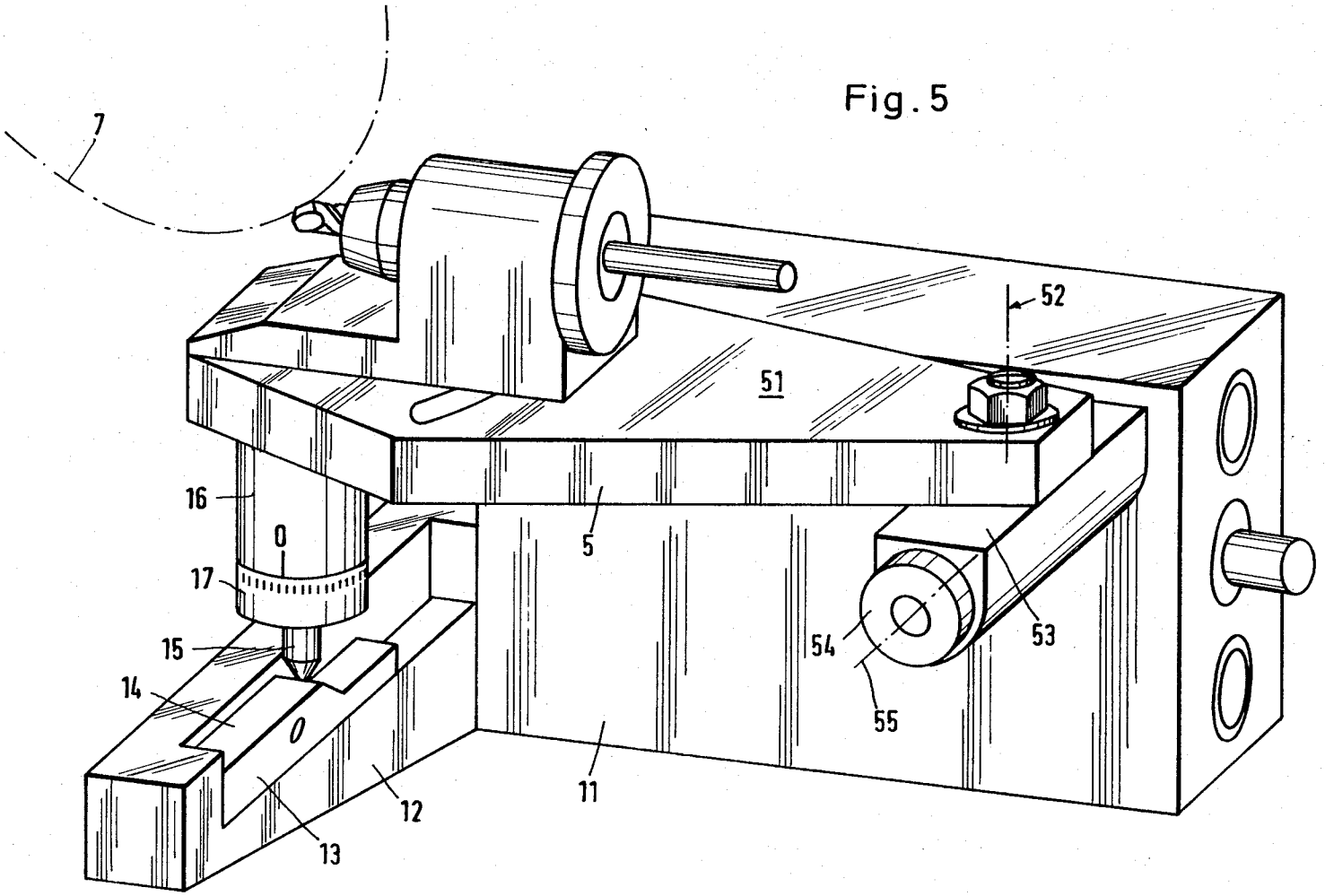
FIG. 5 is a perspective overall view of the tip grinding machine showing a mounted twist drill, the grinding disk being only suggested.

FIG. 5 is a perspective illustration of the entire apparatus for grinding especially for web thinning and split pointing the tips of twist drills. The explanations given above relative to FIG. 3 concerning the drill bit holder and the mounting mechanism therefore also apply to this case and details of construction will not be repeated here for that reason.

FIG. 5 shows that this preferred embodiment uses curvilinear path coordinates. To this end, the support 5 or, as applicable, the support plate 51 are mounted pivotably about the axis 52 on a pivoting boss 53 which rotates around a pivot pin 54 having an axis 55 perpendicular to the pivotal axis 52 of the support 5. In this way, the support and the drill bit 1 have two degrees of rotational freedom that set the required two directions of motion K1 and K2. Due to the relatively large separation of the rotary axes 52 and 55 from the drill tip, these directions of motion may be regarded as being straight lines in a first approximation.

The pivot pin 54 and the highly schematically shown grinding disk 7 are mounted locally fixed in a machine frame 11 to which a carrier plate 12 is fastened below the front end of the support plate 51. The carrier plate 12 serves to receive the control template 13 which has an upper control surface 14 followed by a follower pin 15 fixedly attached to the support 5. As seen in FIG. 5, the follower pin 15 is carried within a guide cylinder 16 mounted on the underside of the support 5 and so constructed that the rotation of a graduated adjusting ring 17 permits a very fine adjustement of the amount the follower pin 15 extends beyond the guide cylinder 16. The template 13 is releasably coupled to the carrier 12 and may be exchanged so that a change of the control surface 14 of the template 13 makes possible the production of various drill tip surfaces patterns for optimum adaptation to a given drill bit geometry.

As shown in the embodiment of FIG. 5, the adjustment for the grinding process is performed suitably by rotation of the ring 17 which moves the pin 15. In general, however, all adjustment motions are advantageous that make use of a direction of guide motion already present in the machine. Thus, for example, the adjustment may take place by sliding the template 13.

In the example shown, the support 5 is moved by hand and the follower motion of the support is ensured by the force of gravity, resulting in a very simple apparatus. However, an automatic support drive may also be provided and the coupling between the given directions of motion is not mandatory. For example, it is possible to provide for two drive mechanisms, each of which controls the motion along one coordinate. Special tip grinding surfaces, obtained by web thinning may be produced by suitable synchronization of the relative motion of the support and the grinding disk while the drill bit is being advanced. Among possible motions of advance are, for example, a rotary motion of the drill bit about its axis, a pivoting of the drill holder or a linear displacement of the drill along its axis.

Prior to the tip grinding process, the drill bit is suitably oriented in the desired manner with the aid of an optical adjusting device.

The foregoing describes an embodiment in which only the support executes the cam-controlled motions that are necessary for carrying out the grinding process. However, it is of course possible also for the support to be locally fixed in the machine frame and for the grinding disk to mounted in a support which is then moved under cam control in the manner described hereinabove. Moreover, it is possible to move both the grinding disk and the support, using both linear and rotational degrees of freedom, even in combination. For example, one may use an apparatus wherein the grinding disk is mounted on a support that can be both displaced and pivoted and whose motion is transmitted directly to the exchangeable template described herinabove, the motion coordinate perpendicular to the motion of the grinding disk then being picked up or followed by the support of the drill bit holder from the template.

Accordingly, the invention creates an apparatus for grinding a twist drill, especially for web thinning and split pointing the tip of a twist drill. The apparatus includes a grinding disk and a drill bit holder capable of movement relative thereto and mounted on a support, the relative motion of the support and the grinding disk being produced by cam controlled or continious path controlled movement so as to obtain tip grinding surfaces of different kinds using a grinding disk having an unchanging profile. The cam control takes place, preferably, via an exchangeable template, making possible the use of a single grinding disk that does not any longer require dressing to obtain a multitude of tip grinding patterns that are optimally adapted to the prevailing drill bit geometry.

Various modifications in structure and/or function may be made by one skilled in the art to the dislcosed embodiments without departing from the scope of the invention as defined by the claims.

What is claimed is:

1. An apparatus for grinding a specific surface of a twist drill bit to a desired contour in accordance with a predetermined controlled path, the drill bit having an axis and an outer tip surface, the specific surface being axially spaced from the outer tip surface of the bit, comprising:

a grinding disk means having a fixed and constant cross-sectional shape and a substantially point contact grinding surface;

a drill bit holder means for fixing the twist drill stationary against movement during the grinding;

means for carrying the drill bit holder means for grinding contact engagement of the drill axially spaced surface with the point contact grinding surface;

replaceable template means for providing the predetermined controlled path in a first coordinate direction of motion between the disk means and the drill bit holder means;

means for providing the predetermined controlled path in a second coordinate direction of motion between the disk means the drill bit holder means; and means for varying the first and second coordinate directions of motion;

the first and second coordinate directions of motion being rotational about two mutually perpendicular axes whereby the relative orientation of the drill bit axis and the grinding disk permits the template means and the second direction means to provide grinding contact engagement between the disk point contact grinding surface and the bit axially spaced surface in accordance with the first and second coordinate directions of motion and independent of the cross-sectional shape of the disk means, the disk point contact surface grinding the bit axially spaced surface to the desired contour.

2. An apparatus according to claim 1 wherein the template means and the second direction means control the movement of the drill bit holder.

3. An apparatus according to claim 1 wherein the grinding disk means is fixed to a frame; and means are provided for urging contact between the template means and the second direction means.

4. An apparatus according to claim 3 wherein the urging means is the force of gravity.

5. An apparatus according to claim 1 wherein the drill bit holder means comprises a chuck for the drill bit, a drill holder affixed to a support plate and means for orienting the drill holder at a desired angular direction to the disk means.

6. An apparatus according to claim 1 wherein the first and second coordinate directions of motion is provided by a plate supporting the drill holder means, the plate being pivotable about a first bearing pin and pivotable about a second bearing pin perpendicular to the first bearing pin.

7. An apparatus according to claim 1 wherein the first and second coordinate directions of motion are varied by a pin which follows a control surface of the template means.

8. An apparatus according to claim 7 wherein the pin is disposed in a guide cylinder, the guide cylinder includes means for adjusting the extension of the pin.

9. An apparatus according to claim 1 wherein the first coordinate direction of motion is linear in a first approximation.

10. An apparatus according to claim 1 wherein the second coordinate direction of motion is linear in a first approximation.

11. An apparatus according to claim 1 wherein the disk means has a diamond coating.

12. An apparatus according to claim 1 wherein the disk means has a boron nitride coating.

13. An apparatus according to claim 1 wherein the cross-sectional contour of the disk means is conical.

14. An apparatus according to claim 1 wherein the disk means has a conical edge surface which is in grinding contact engagement with the specific surface.

15. An apparatus according to claim 1 wherein the coordinate directions of motion are rotatable about a pivot at an end of the drill bit holder.

16. An apparatus according to claim 1 wherein the template means is spaced from the relative intersection of the two rotational axes.

17. An apparatus according to claim 1 wherein the template means is linear.

18. A method for grinding a specific surface of a twist drill bit to a desired contour in accordance with a predetermined controlled path, the drill bit having an axis and an outer tip surface, the specific surface being axially spaced from the outer tip surface of the bit, comprising the steps of:

providing a grinding disk having a fixed and constant cross-sectional shape and a substantially point contact grinding surface;

maintaining the drill bit stationary within a drill bit holder while in grinding contact engagement between the axially spaced surface and the point contact grinding surface;

providing the predetermined controlled path in a first coordinate direction of motion between the disk and the drill bit;

providing the predetermined controlled path in a second coordinate direction of motion between the disk and the drill bit;

a replaceable template having a defined control surface for providing the predetermine controlled path;

the first and second coordinate directions of motion being rotational about two mutually pependicular axes whereby the relative orientation of the drill bit axis and the grinding disk permits grinding contact engagement between the disk point contact grinding surface and the bit axially spaced surface in accordance with the first and second coordinate directions of motion and independent of the cross-sectional shape of the disk surface, the disk point contact surface grinding the bit axially spaced surface to the desired contour.

19. A method according to claim 18 wherein the first coordinate direction of motion is linear in a first approximation.

20. A method according to claim 18 wherein the second coordinate direction of motion is linear in a first approximation.

21. A method according to claim 18 wherein a pin follows the control surface by the force of gravity.

22. A method according to claim 18 wherein the crosssectional shape of the disk is conical.

23. A method according to claim 18 wherein the disk has an axis of rotation which is substantially parallel to one of the coordinate directions of motion.

24. A method according to claim 18 wherein the disk has a conical edge surface which is in grinding contact engagement with the adjacent drill surface.

25. A method according to claim 18 wherein the coordinate directions are rotatable about a pivot at an end of the drill bit holder.

26. A method according to claim 18 wherein the template is spaced from the relative intersection of the coordinate directions of motion.

27. A method according to claim 18 wherein the template is linear.

* * * * *